United States Patent [19]

Petitto, Sr. et al.

[11] 4,411,583

[45] Oct. 25, 1983

[54] MULTI-PURPOSE MATERIAL HANDLING MACHINE FOR USE IN A MINE

[75] Inventors: Angelo S. Petitto, Sr.; Angelo A. Petitto; James L. Petitto, all of Morgantown, W. Va.

[73] Assignee: Petitto Mine Equipment Repair, Inc., Morgantown, W. Va.

[21] Appl. No.: 201,277

[22] Filed: Oct. 27, 1980

[51] Int. Cl.[3] ..... B60P 1/54

[52] U.S. Cl. ..... 414/687; 414/723; 414/912; 414/718; 414/740; 37/117.5

[58] Field of Search ..... 37/117.5, 118 A, 183 A; 414/912, 916, 718, 722, 723, 728, 740, 687; 172/272–275; 138/155; 280/504

[56] References Cited

U.S. PATENT DOCUMENTS

| | | | |
|---|---|---|---|
| 2,067,879 | 1/1937 | Whitmire | 214/134 |
| 2,432,589 | 12/1947 | Sauder | 414/686 |
| 2,949,201 | 8/1960 | MacAlpine et al. | 214/657 |
| 3,008,251 | 11/1961 | Cline et al. | 37/143 |
| 3,032,900 | 5/1962 | Kashergen | 414/722 X |
| 3,049,252 | 8/1962 | Noll | 214/145 |
| 3,061,122 | 10/1962 | Robbins | 214/132 |
| 3,187,916 | 6/1965 | O'Leary | 214/657 |
| 3,226,857 | 1/1966 | Porter et al. | 37/126 |
| 3,341,040 | 9/1967 | Blair | 214/140 |
| 3,341,041 | 9/1967 | Salna | 37/117.5 |
| 3,375,595 | 4/1968 | Beltrami | 37/117.5 |
| 3,705,656 | 12/1972 | Hunger et al. | 214/145 |
| 3,842,999 | 10/1974 | Asbury | 214/145 |
| 3,845,871 | 11/1974 | DiLillo et al. | 214/145 |
| 3,854,608 | 12/1974 | Arnold | 37/117.5 X |
| 3,869,054 | 3/1975 | Moreau | 37/118 A |
| 3,934,738 | 1/1976 | Arnold | 414/723 |
| 3,985,249 | 10/1976 | Aker et al. | 414/723 |
| 3,991,886 | 11/1976 | Thorsell | 214/1 MS |
| 4,080,746 | 3/1978 | Frazzini | 37/117.5 |
| 4,117,610 | 10/1978 | Yates | 37/117.5 |
| 4,133,121 | 1/1979 | Hemphill | 37/118 R |
| 4,187,050 | 2/1980 | Barbee | 414/723 |
| 4,199,299 | 4/1980 | Pettito, Sr. et al. | 414/687 |

FOREIGN PATENT DOCUMENTS

| | | | |
|---|---|---|---|
| 2328207 | 12/1973 | Fed. Rep. of Germany | 214/132 |
| 644056 | 10/1950 | United Kingdom | 214/132 |

*Primary Examiner*—Joseph E. Valenza
*Assistant Examiner*—Terrance L. Siemens
*Attorney, Agent, or Firm*—Stanley J. Price, Jr.; John M. Adams

[57] ABSTRACT

A self-propelled vehicle maneuverable in an underground mine includes a low profile mobile body with a forwardly extending boom. Piston cylinder assemblies extending between the boom and the mobile body are operable to both laterally and vertically pivot the boom relative to the mobile body. A bracket extends forwardly from the outer end of the boom. The bracket is releasably engageable with a bracket receiver of a multi-purpose bucket by a pair of quick release pins. The bucket includes a movable portion connected by a pivot mechanism to a carrier portion. Piston cylinder assemblies extending between the movable and carrier portions are operable to generate pivotal movement of the movable portion toward and away from the carrier portion to locate the movable portion in a preselected operating position relative to the carrier portion for conducting selected material handling operations. With the bucket movable portion in a fully retracted position within the bucket carrier portion, the bucket is operable to carry out bulldozing and loading operations in a mine. The contents of a loaded bucket are discharged by actuating the piston cylinder assemblies to pivot the bucket movable portion forwardly away from the bucket carrier portion. The bucket is also operable as a clamshell. The versatility of the vehicle is enhanced by the ability to efficiently replace the multi-purpose bucket on the end of the boom with another material handling device.

13 Claims, 7 Drawing Figures

MULTI-PURPOSE MATERIAL HANDLING MACHINE FOR USE IN A MINE

BACKGROUND OF THE INVENTION

1. Field of the Invention

This invention relates to a multi-purpose material handling machine and more particularly to a self-propelled mine vehicle having a telescoping boom adapted for efficient attachment and detachment to a multi-purpose bucket that is maneuverable by the extensible boom to a preselected position for conducting a variety of material handling operations in an underground mine.

2. Description of the Prior Art

In underground mining operations it is well known to utilize shovel and scoop-type machines in the handling and transportation of loose or mined material in the mine. U.S. Pat. Nos. 3,226,857 and 4,117,610 and Fed. Rep. of Germany Pat. No. 2,328,207 are examples of such devices. These devices, however, are confined generally to use in a bulldozing mode of operation to pick up a pile of loose material and transport the material to a location in the mine for unloading, such as onto a haulage belt or into a material haulage vehicle. Another disadvantage of these vehicles is the lack of maneuverability of the shovel or scoop in the limited working space of an underground mine to gather up, transport, and discharge the material. Furthermore, the manner in which the shovel or scoop is connected to the prime mover is generally complex and limits the versatility of the material handling machine for conversion to some other material handling operation in an underground, such as unloading the material at an elevated height above the prime mover or carrying out clamshell operations as when encountered in cleaning up a roof fall in an entry.

In the operations of sinking vertical shafts or caissons, as well as, sinking a shaft at an angle between the horizontal and vertical, mucking machines or excavators as disclosed in U.S. Pat. No. 2,949,201 are conventionally used. A mucking machine of this type has a swingable, telescoping boom with a clam mounted on the free end of the boom. The boom is operated for lateral swinging movement, as well as, for extending and retracting the boom to open and close the clam.

In the above referenced patent, the boom is pivotally mounted on a cage by vertical pins, and the cage pivotally supports the boom turntable. The boom swings laterally on the turntable by operation of piston cylinders. Additional piston cylinders are provided to lift the boom about a horizontal axis. Other similar mucking machines are disclosed in U.S. Pat. Nos. 2,067,879; 3,187,916; and 3,991,886. A major disadvantage of this type of machine is limited maneuverability in an entry, cross cut, or pillar section due to the complex linkage and control means for moving the clam into and out of position and to open and close the clam.

It is well known in above ground earth moving and excavation operations to combine in one machine the operations of earth collecting, transporting, and earth discharging with bulldozing operations. These machines are quite large as disclosed in U.S. Pat. Nos. 3,842,999 and 4,080,746 and are therefore not readily adaptable to undergrounding mining operations. Also the complex linkages connecting the bucket to the boom of an above ground excavating machine are undesirable from a maintenance standpoint for use in an underground mine.

Machines employed in underground mining operations must be capable of operating in areas of minimum overhead clearance. Consequently, the above ground earth excavating and transporting machines, as above described, are inoperable to perform the functions performed above ground in an underground mine. Therefore, there is a need for a multi-purpose material handling vehicle operable to carry out a wide variety of operations in an underground mine. The frame of the machine must have a minimum height to permit the vehicle to maneuver freely in the passageways of the mine. Once in position the material handling device must be freely maneuverable to engage the material to be transported or to clear a section by tramming of the machine. In addition the ability to convert a material handling machine from one use to another is advantageous in a mine.

With the conventionally known devices conversion is a problem because of the space limitations available for workmen to replace components on a machine. Also the presence of complex linkage connections between a bucket, for example, and the prime mover as encountered with conventional devices restricts the efficiency in converting a machine from one use to another. This problem leads to delays in the overall mining operation.

While it is known with above ground machinery to provide a quickly attachable and detachable loader bucket on the end of a boom of a prime mover as disclosed in U.S. Pat. Nos. 3,705,656; 3,845,871; and 4,187,050, the known quick disconnect devices are not efficiently operated in the limited space of an underground mine. The complex linkages of these devices are also vulnerable to frequent breakdown in the working environment of an underground mine.

While it has been suggested to provide multi-purpose buckets that are removably attachable to the front end of a self-propelled vehicle, the prior art devices require complex linkages incapable of sustained operation without frequent servicing in an underground mine. The overall size of the above ground machines substantially limit their operating capability when placed in an underground environment. The known underground devices are also unacceptable due to their limited versatility to carry out a plurality of material handling operations and are not efficiently convertible from one use to another in an underground passageway.

SUMMARY OF THE INVENTION

In accordance with the present invention there is provided a multi-purpose material handling machine that includes a mobile body and a boom assembly extending from the mobile body. The boom assembly has a first end portion positioned on the mobile body and a second end portion spaced from the first end portion and the mobile body. The second end portion is extensible and retractable relative to the first end portion to change the length of the boom assembly. The boom assembly first end portion is pivotally connected to the mobile body for both lateral and vertical pivotal movement of the boom assembly relative to the mobile body. First actuating means mounted on the mobile body and connected to the boom assembly pivots the boom assembly both laterally and vertically relative to the mobile body. A multi-purpose bucket includes a movable portion and a carrier portion. Pivot means connects the movable portion to the carrier portion to permit pivotal movement of the movable portion toward and away from the carrier portion. Second actuating means extending between the bucket movable and carrier portions moves the movable portion to a preselected operating position relative to the carrier portion. A bracket extends forwardly from the boom assembly second end portion. A bracket receiver extends rearwardly from the bucket carrier portion into contact with the bracket with the boom assembly positioned centrally behind the multi-purpose bucket. Quick release pin means connects the bracket receiver to the bracket to permit efficient attaching and detaching of the multi-purpose bucket to the boom assembly. Extensible means extends and retracts the boom assembly to selectively maneuver the multi-purpose bucket into position for conducting material handling operations.

The bucket movable portion is formed by a generally horizontal bottom wall connected to upwardly extending spaced apart side walls. The side walls of the bucket movable portion are positioned within the side walls of the bucket carrier portion which also includes a downwardly extending back wall connected to a bottom wall that extends between the side walls of the carrier portion. A bulldozer blade is secured to and extends across the front of the carrier bottom wall. The bulldozer blade with the movable portion in a raised position is operable to carry out bulldozing operations when maneuvered into position by the extensible boom assembly.

The back wall of the carrier portion is provided with a pair of openings positioned at the upper portion of the back wall and adjacent the side walls of the movable portion. A pivot housing is secured inboard of each side wall of the movable portion opposite the respective opening through the back wall of the carrier portion. Pivot pins passing through the pivot housings and the side walls of the carrier portion form the pivot means for pivotally connecting the movable portion to the carrier portion. Bifurcated ends of the pivot housings extend through the openings in the carrier portion back wall for connection to piston rods of the second actuating means.

Extension and retraction of the piston rods upon operation of the second actuating means initiates pivotal movement of the movable portion relative to the carrier portion about the pivot housings. With this arrangement the movable portion is movable to a preselected position relative to the carrier portion. Thus the multi-purpose bucket is manueverable to a selected one of a plurality of positions for carrying out selected material handling operations, such as bulldozing, grading, transporting, and the like of dislodged material in an underground mine.

The bracket receiver includes a pair of spaced apart plates arranged to receive in sliding contact a pair of complementary plates forming the bracket on the end of the boom second end portion. Plates of the bracket receiver, as well as, the plates of the bracket are provided with holes that are moved into alignment to receive a pair of quick release pins. The correct alignment of the holes is obtained when the second end of the boom is positioned in abutting relation with the ends of the bracket receiver plates. Extending the pins through the aligned holes completes the connection of the multipurpose bucket to the end of the boom.

Accordingly, the principal object of the present invention is to provide a multi-purpose material handling machine operable in underground mining operations to efficiently carry out by operation of a mutli-purpose bucket a plurality of material handling operations.

Another object of the present invention is to provide a self-propelled vehicle maneuverable in an underground mine and including an extensible boom having a multi-purpose bucket quickly attachable and detachable on the end of the boom and maneuverable by the boom to conduct bulldozing, grading, transporting, unloading, and like operations.

A further object of the present invention is to provide a multi-purpose bucket operable in a plurality of modes to conduct material handling operations in an underground mine and capable of rapid attachment and detachment to the end of an extensible boom of a self-propelled underground vehicle.

These and other objects of the present invention will be more completely disclosed in the following specification, the accompanying drawings, and the appended claims.

DESCRIPTION OF THE PREFERRED EMBODIMENT

Figure 1:
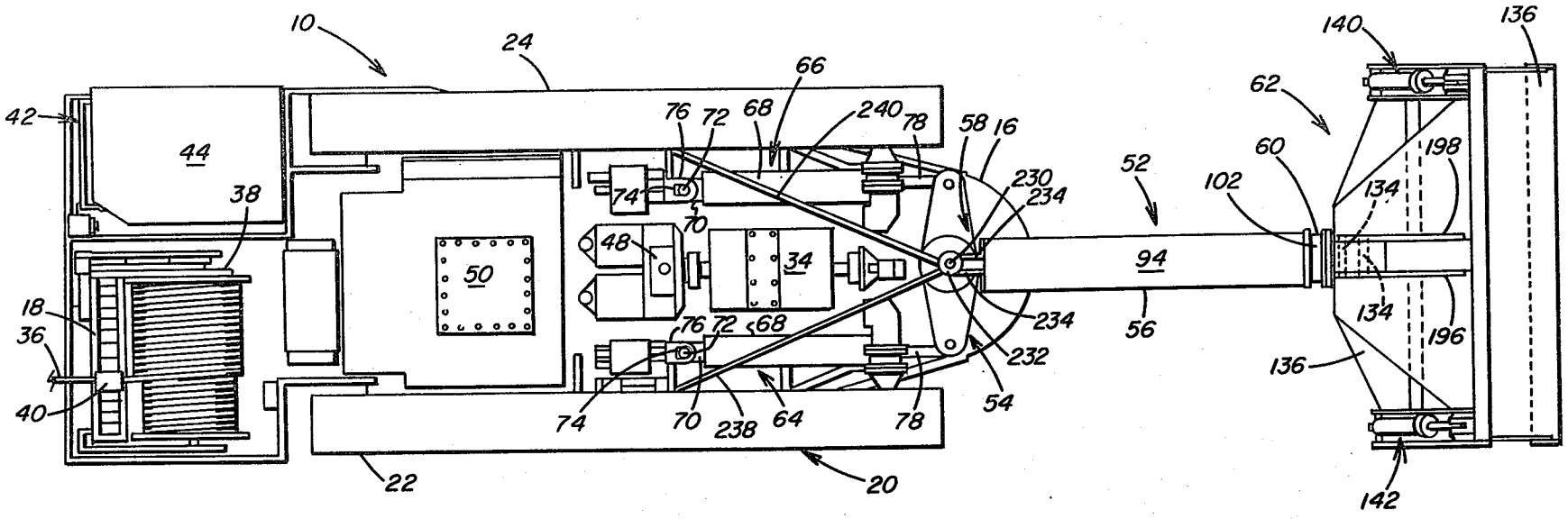
FIG. 1 is a top plan view of a self-propelled vehicle for use in an underground mine to perform material handling operations, illustrating a telescoping boom having a multi-purpose bucket releasably engagable to the end of the boom.
Figure 2:
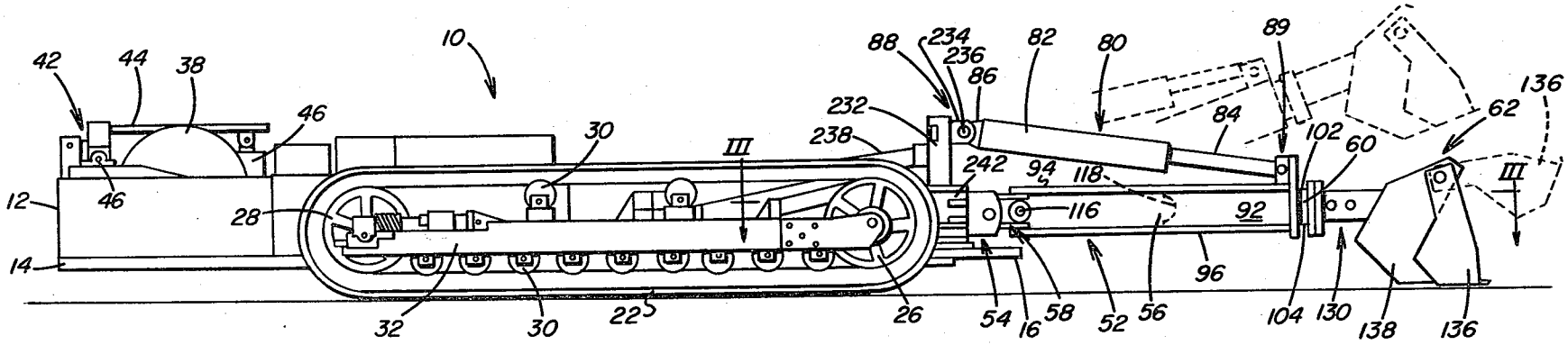
FIG. 2 is a view in side elevation of the vehicle shown in FIG. 1, illustrating various positions of the extensible boom and the multi-purpose bucket.

Referring to the drawings and particularly to FIGS. 1 and 2 there is illustrated a material handling vehicle generally designated by the numeral 10 for use in underground mining operations or in any type of underground excavation work. The material handling vehicle 10 includes a body portion 12 having a longitudinally extending frame 14. The frame 14 has a front end portion 16 and a rearward end portion 18. The frame 14 of the mobile body 12 is mounted on ground engaging traction devices 20, such as a pair of propelling endless tracks 22 and 24. Each of the tracks 22 and 24 are reeved about a driven sprocket 26 and an idler sprocket 28 with idler rollers 30 supported by a frame 32 that extends between and is connected to the sprockets 26 and 28. The idler rollers 30 support the upper and lower reaches of the endless track as it turns in a preselected direction upon rotation of the driven sprocket 26. The driven sprocket 26 for each endless track 22 and 24 is drivingly connected, in a manner not shown, to a suitable prime mover 34, such as an electric motor which is secured to the vehicle frame 14. Electrical power is supplied to the motor 34 through an electrical cable 36 wound upon a cable reel 38 by a spooling device 40. The cable reel 38 is mounted on the rearward end portion 18 of the frame 14 adjacent to an operator's station and includes an overhead canopy 44 that is raised and lowered by piston cylinder assemblies 46 as determined by the overhead clearance provided between the top of the vehicle 10 and the mine roof. The operator's station is provided with controls for propelling and steering the vehicle, as well as, for carrying out the mine excavation and material handling operations performed by the vehicle 10 in accordance with the present invention.

The motor 34 is also used to operate a fluid pump 48 that supplies fluid under pressure to the various fluid operated devices on the vehicle 10, such as the fluid actuated piston cylinder assemblies provided on the mobile body 12 and to be described later in greater detail. The fluid pump 48 supplies fluid, such as hydraulic fluid from a tank 50 mounted on the frame 12 through conventional hydraulic conduits (not shown) to the various fluid operated devices. The controls for supplying fluid to the fluid operated devices are located at the operator's station 42, together with the electrical controls by which the speed and direction of movement of the vehicle 10 is controlled.

A telescoping boom assembly, generally designated by the numeral 52, extends forwardly from the front end 16 of frame 14 and is supported thereon by a pivot arrangement 54 for carrying out lateral swinging movement of the boom assembly 52. The boom assembly 52 includes a first portion 56 that is secured to the pivot arrangement 54 by connecting apparatus 58 in a manner to facilitate upward and downward movement of the entire boom assembly 52. A second end portion 60 of the boom assembly 52 is extensible out of and into the boom first end portion 56 and includes at its outer end portion a multi-purpose bucket generally designated by the numeral 62. As will be described later in greater detail a number of material handling operations are performed by the multi-purpose bucket 62 in conducting underground mining operations.

The multi-purpose bucket 62 is moved by the boom assembly 52 relative to the mobile body 12. Lateral movement of the boom assembly 52 is accomplished through the pivot arrangement 54 by operation of a pair of fluid actuated devices, such as piston cylinder assemblies 64 and 66. Each of the assemblies 64 and 66 includes a cylinder portion 68. The cylinder portion 68 includes a connecting end portion 70 having a lug 72 extending upwardly therefrom. The lug 72 is received within a longitudinal slot 74 of a bracket member 76. The bracket member 76 is securely mounted to the vehicle frame 14. This arrangement permits pivotal movement of the cylinder portion 60 during its operation. The opposite end portion of each of the assemblies 64 and 66 includes a piston rod 78 that is extensible from the cylinder portion 68 and is secured at its outer end portion to the pivot arrangement 54.

The piston cylinder assemblies 64 and 66 are operable in pairs to effect lateral swinging movement of the boom assembly 52 at the front end 16 of frame 14. Thus, in order to swing the boom assembly 52 laterally in a clockwise direction on the frame 14, assembly 66 is actuated to extent its piston rod 78 from the cylinder 68; while, the piston rod 78 of assembly 64 is retracted into the cylinder portion 68. Preferably, a single control is provided to effect the coordinated extension and retraction of the piston rods 78 of the assemblies 64 and 66. Conversely, to swing the boom assembly 52 laterally in a counterclockwise direction the piston rod 78 of assembly 64 is extended and the piston rod 78 of assembly 66 is simultaneously retracted.

Independently of the lateral swinging movement of the boom assembly 52, the boom assembly is also operable to move upwardly and downwardly to position the multi-purpose bucket 62 at a preselected elevation relative to the frame 14 or relative to the mine roof and mine floor in an underground mine. Upward and downward movement of the boom assembly 52 is accomplished by a fluid actuated device, such as a piston cylinder assembly 80 having a cylinder portion 82 and a piston rod 84 movable into and out of the cylinder portion 82. The piston cylinder 80 is illustrated in FIG. 2 but has been removed from FIG. 1 in order to more clearly illustrate the boom assembly 52. The cylinder portion 82 is pivotally connected at its end portion 86 by a clevis-type connection 88 to the pivot arrangement 54.

The outer end of the piston rod 84 is also connected by a clevis-type connection 89 to the boom assembly 52 and more specifically to the outer end of the boom assembly first end portion 56. With this arrangement, extension and retraction of the piston rod 84 moves the boom assembly 52 together with the multi-purpose bucket 62 upwardly and downwardly as the end portion of the boom assembly 52 adjacent the pivot arrangement 54 pivots about the connecting apparatus 58 that connects the boom assembly 52 to the pivot arrangement 54. Thus the boom assembly 52 is movable both vertically and laterally in an arcuate path at the front end of the mobile body 12.

Figure 3:
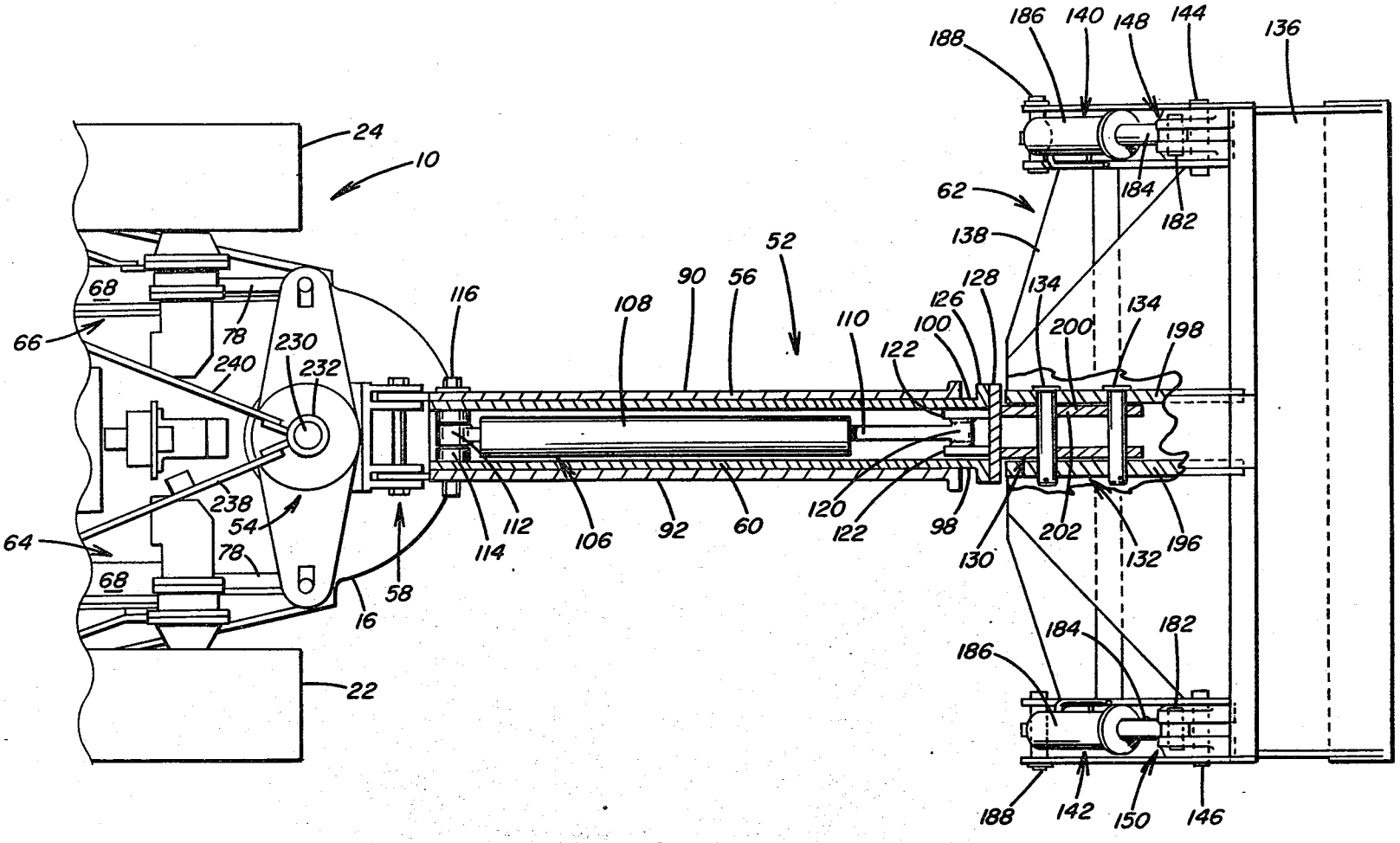
FIG. 3 is a fragmentary plan view, partially in section, taken along line III—III of FIG. 2, illustrating a piston cylinder assembly housed within the boom for extending and retracting the boom and the quick release connection of the bucket to the end of the boom.

Referring to FIG. 3, there is illustrated in greater detail, the construction of the boom assembly 52 and the manner in which the boom assembly is extended and retracted to selectively position the multi-purpose bucket 62. The boom assembly first end portion 56 has a channel configuration formed by a pair of laterally spaced side plates 90 and 92 which are suitably connected to a top plate 94 and a bottom plate 96 as illustrated in FIGS. 1 and 2. The top plate 94 has been removed in FIG. 3 to more clearly illustrate the channel construction of the boom assembly first end portion 56 for receiving the boom assembly second end portion 60. The second end portion 60 has laterally spaced side plates 98 and 100 connected to laterally spaced top and bottom plates 102 and 104 respectively. The plates 98–104 thus form a rectangular shaped channel having a cross-sectional area which is less than the cross-sectional area formed by the plates of the boom assembly first end portion 56. This permits slidable movement of the boom assembly second end portion 60 relative to the boom assembly first end portion 56 to provide the telescoping action of the boom assembly 52.

In FIG. 3 the boom assembly second end portion 60 is shown retracted within the boom assembly first end portion 56 and the top plates 94 and 102 removed to illustrate a fluid actuated device, such as piston cylinder assembly 106. The piston cylinder assembly 106 is positioned within the channel shaped boom assembly second end portion 60 which, is in turn, positioned within the channel shaped boom assembly first end portion 56. The assembly 106 is operable upon actuation to extend and retract the boom second end portion 60 relative to the boom first end portion 56 to change the effective length of the boom assembly 52.

The assembly 106 includes a piston cylinder 108 and an extensible piston rod 110. The cylinder 108 has an end portion 112 with a bore therethrough. The end portion 112 is aligned with a pair of coaxially positioned bosses 114. The bosses 114 are secured to the inner surface of side plates 90 and 92. A pin 116 extends through aligned bores of the side plates 90 and 92, the bosses 114, and the cylinder end portion 112. In this manner the end portion of the piston cylinder assembly 106 is secured for the movement with the boom assembly first end portion 56. As explained in greater detail in the U.S. Pat. No. 4,199,299 the side plates 98 and 100 of the boom assembly second end portion 60 are constructed to permit the boom second end portion 60 to be fully retracted within the boom first end portion 56 without interference by the pin 116 at the inner end of the boom second end portion 60.

The outer end of the piston rod 110 of assembly 106 includes an enlarged end portion 120 having a bore therethrough, which bore is aligned with bores extending through a pair of ears 122. The ears 122 are secured to the boom second end portion 60. A pin (not shown) extends through aligned bores of rod end portion 120 and ears 122 to secure the piston rod 110 to the boom second end portion 60. Thus upon actuation of the piston cylinder assembly 106, extension of the piston rod 110 from the cylinder 108 extends the boom second end portion 60 relative to the boom first end portion 56. Accordingly, retraction of the piston rod 110 into the cylinder 108 retracts the boom second end portion 60 into the boom first end portion 56. In this manner, the boom assembly 52 is adjustable to a preselected length.

Figure 4:
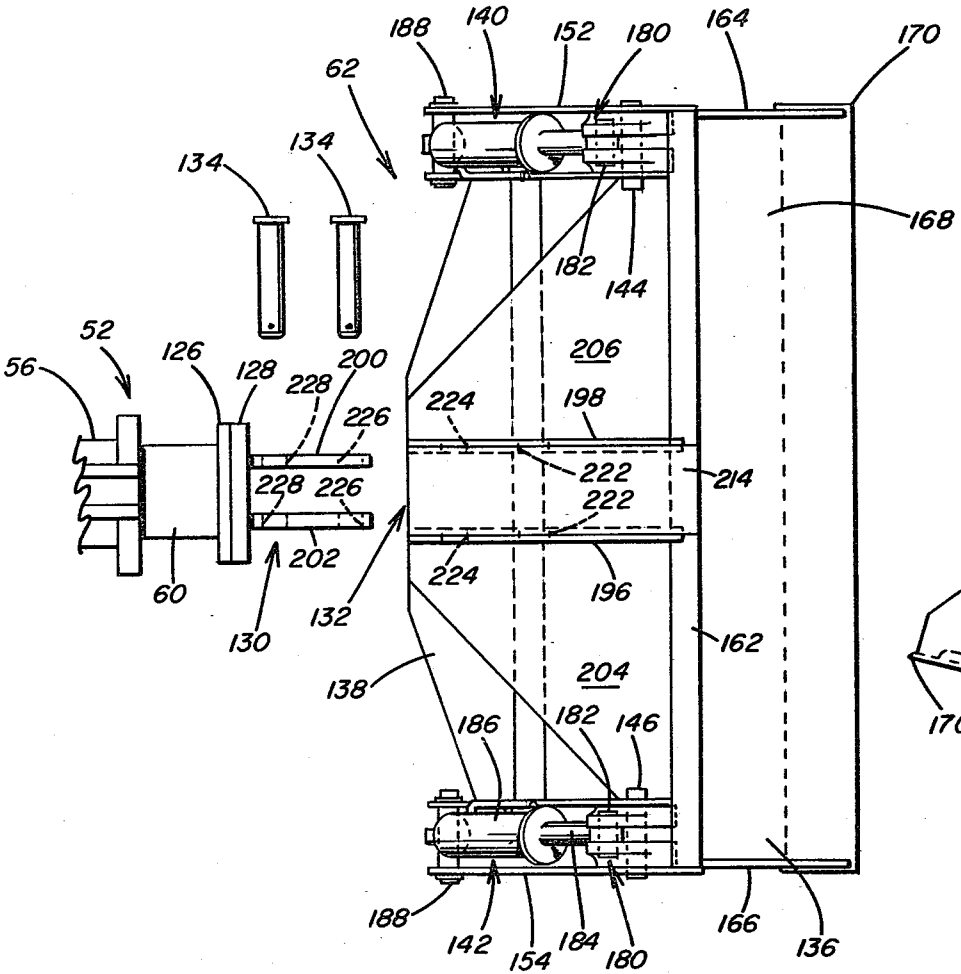
FIG. 4 is a fragmentary exploded plan view of the end of the boom and the multi-purpose bucket, illustrating the quick release pin connection of a bracket on the end of the boom to a bracket receiver of the bucket.

As illustrated in FIG. 3 and in greater detail in FIG. 4, the multi-purpose bucket 62 is secured to the outer end of the boom assembly second end portion 60. The outer end of the boom assembly second end portion 60 includes a plate member 126 that is suitably secured to the side plates 98 and 100 and the top and bottom plates 102 and 104. A plate 128 is secured as by bolts to the plate 126. The pair of ears 122 extend through aligned slots (not shown) cut in plates 126 and 128 and are suitably welded thereto to secure the pair of ears to the plates 126 and 128. The end portions of the ears 122 that extend beyond the plate 128 and forwardly from the boom assembly 52 form a bracket generally designated by the numeral 130. The bracket 130 is connected to a bracket receiver generally designated by the numeral 132 located at the rear of the multi-purpose bucket 62 by means of a pair of quick release pins 134 in a manner to permit efficient attachment and detachment of the multi-purpose bucket 62 to the boom assembly 52.

The multi-purpose bucket 62, as illustrated in detail in FIGS. 4–7, includes a movable portion 136 and a carrier portion 138. The bucket carrier portion 138 is connected by the quick release pins 134 to the boom bracket 130. The bucket movable portion 136 is pivotally connected to the carrier portion 138 and is operable by suitable actuating devices, such as a pair of piston cylinder assemblies 140 and 142 to move to a preselected operating position relative to the carrier portion 138. A pair of pivot pins 144 and 146 extend through aligned holes in the carrier portion 138 and a pair of pivot housings generally designated by the numerals 148 and 150 of the movable portion 136 to connect to movable portion 136 to the carrier portion 138.

Figure 7:
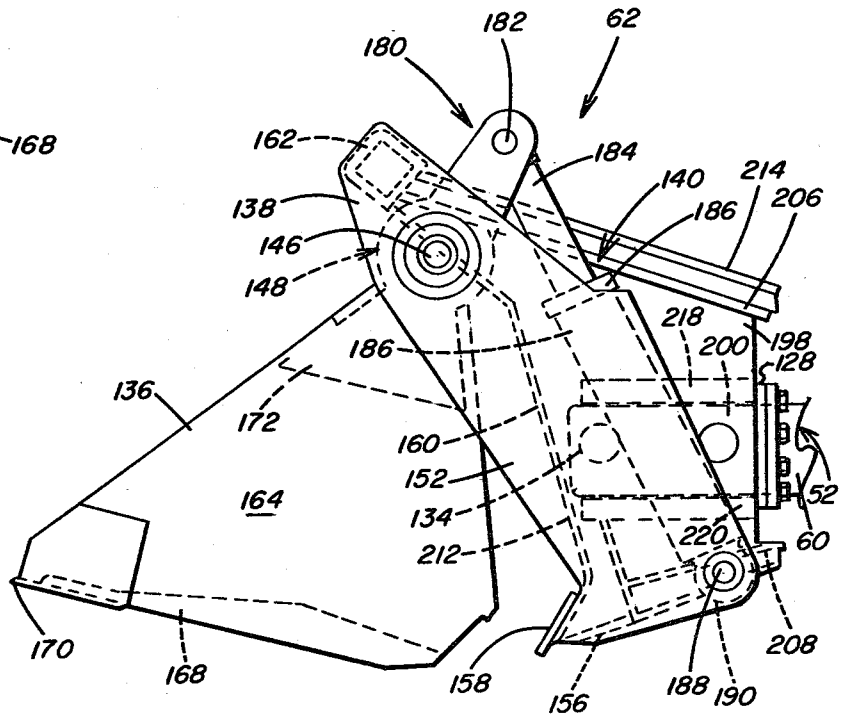
FIG. 7 is a fragmentary view in side elevation of the multipurpose bucket, illustrating the bucket movable portion pivoted away from the bucket carrier portion.

As illustrated in detail in FIGS. 4–7, the bucket carrier portion 138 includes a pair of laterally spaced side walls 152 and 154 which are rigidly secured to a bottom wall 156. A cutting edge plate 158, as shown in FIG. 7, is secured to the lower lateral edges of the front of the sidewalls 152 and 154 and extends transversely across and is secured to the forward bottom edge of the bottom wall 156. The cutting edge plate 158 is operable to carryout bulldozing and grading operations, as will be described later in greater detail.

In combination with the cutting edge plate 158, the bottom wall 156 and the side walls 152 and 154 are joined by a back wall 160 which is welded or rigidly secured in a suitable manner to both of the side walls 152 and 154, as well as, the bottom wall 156. In a bulldozing mode of operation of the multi-purpose bucket 62, the back wall 160 serves as a mold board. As also illustrated in FIG. 7, the back wall 160 extends upwardly from the forward edge of the bottom wall 156 in an arcuate path. The sidewalls 152 and 154 are rigidly secured to the back wall 160 to provide an enclosed area adapted for collecting and discharging material from the bucket carrier portion 138. Further as seen in FIG. 7, the back wall 160 is reinforced at its upper end portion by a reinforcing member 162 that extends transversely between and is secured to the side walls 152 and 154.

The bucket movable portion 136 which is pivotally connected to the bucket carrier portion 138 also includes a pair of side walls 164 and 166 that are positioned inboard and closely adjacent to the carrier portion side walls 152 and 154 respectively. The side walls 164 and 166 are maintained in spaced lateral relation by a bottom wall 168. The bottom wall 168 has arcuate forward edge 170. When the bucket movable portion 136 is in a fully retracted or closed position within the bucket carrier portion 138, the cutting edge plate 158 of the carrier portion 138 is positioned in abutting relation with rear of the bottom wall 168 of the movable portion 136. Also when the movable portion 136 is fully retracted within the carrier portion 138, the back wall 160 of the carrier portion 138 closes the open back of the movable portion 136 between the sidewalls 164 and 166. With this arrangement, the multi-purpose bucket 62 is operable to carry out loading and transporting operations.

Figure 5:
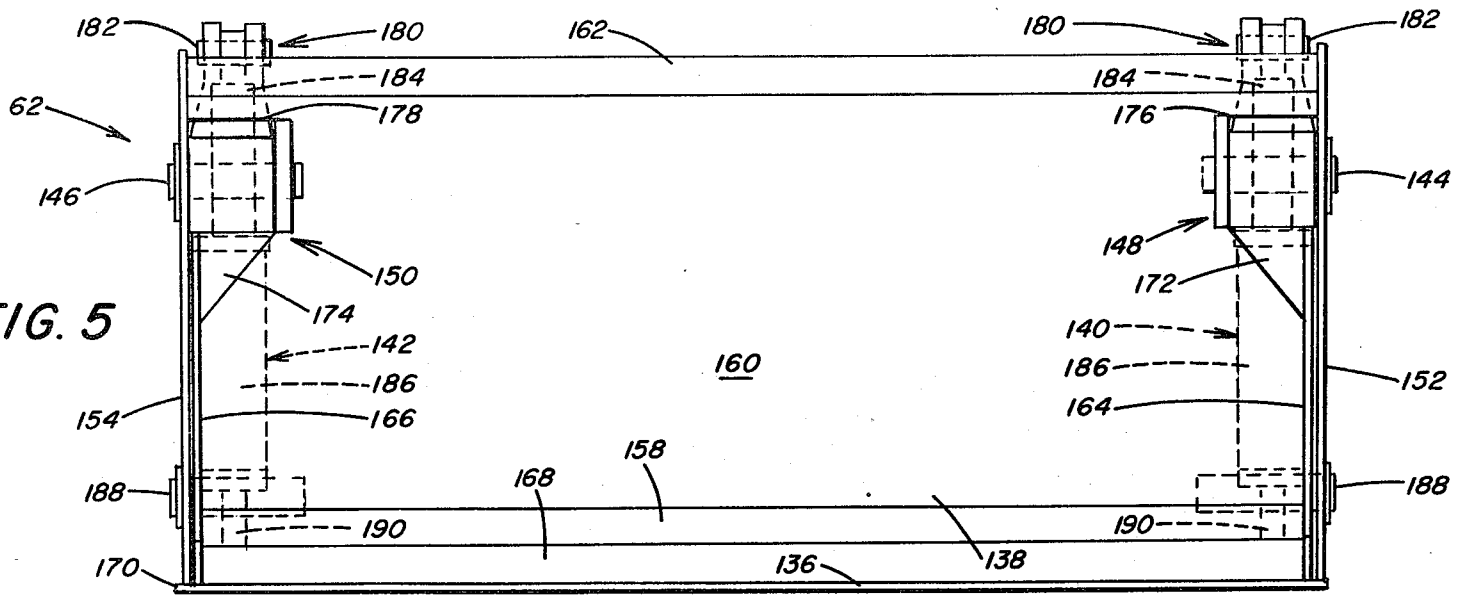
FIG. 5 is a front elevational view of the multi-purpose bucket, illustrating the pivotal connection of a movable portion of the bucket to a carrier portion of the bucket.

As seen in FIG. 5, the sidewalls 164 and 166 of the bucket movable portion 136 are positioned inboard of the side walls 152 and 154 of the bucket carrier portion 138. The bucket movable portion 136 is movable toward and away from the bucket carrier portion 138 and also the movable portion 136 is pivotal to a position within the carrier portion 138 where the back edge of the side walls 164 and 166 abut the back wall 160 of the bucket carrier portion 138 to thereby close the otherwise open rearward portion of the bucket movable portion 136.

Suitably secured to the inboard side of each of the movable portion side walls 164 and 166 are a pair of pivot housing supports 172 and 174. The respective pivot housings 148 and 150 are secured to and supported by the respective supports 172 and 174. Positioned opposite the pivot housings 148 and 150 are a pair of openings 176 and 178 in the back wall 160 of the carrier portion 138. Each of the pivot housings 148 and 150 includes a through bore which is aligned with a corresponding bore through the respective adjacently positioned pairs of side walls 152, 164 and 154, 166. The bores in the pivot housing 148 and side walls 152 and 164 are aligned, as well as, the bores through the pivot housing 150 and side walls 154 and 166 to receive the respective pivot pins 146 and 148.

Figure 6:
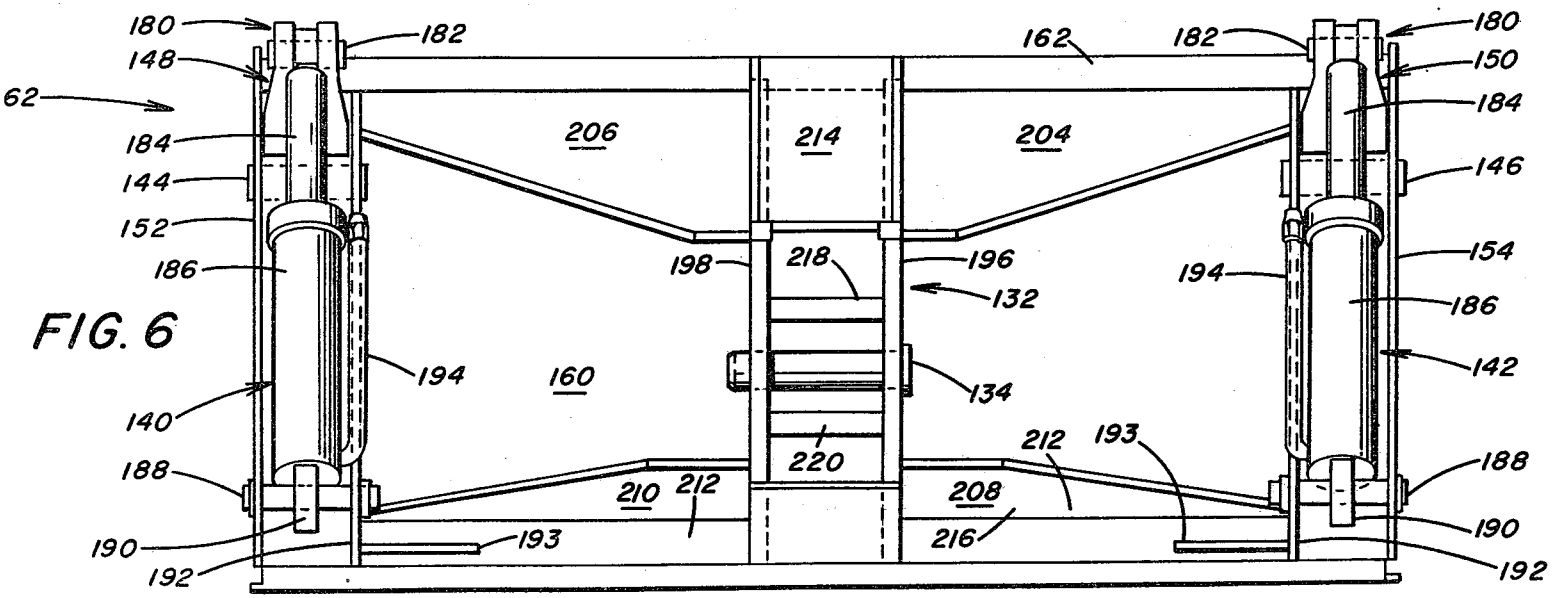
FIG. 6 is a rear elevational view of the multi-purpose bucket shown in FIG. 5, illustrating the bracket receiver and one of the quick release pins for engaging the boom bracket and a pair of piston cylinder assemblies for pivoting the bucket movable portion relative to the bucket carrier portion.

The pivot pins 144 and 146 connect the movable portion 136 to the carrier portion 138 to permit pivotal movement of the movable portion 136 toward and away from the carrier portion 138. The pivotal movement is actuated by the piston cylinder assemblies 140 and 142. Thus as can be seen in FIGS. 5 and 6, by positioning the pivotal connection of the movable portion 136 to the carrier portion 138 inboard of the movable portion sidewalls 164 and 166, the multi-purpose bucket 62 can be maneuvered in a mine into position where either one of the side walls 152 or 154 of the carrier portion 138 can be positioned closely adjacent to a mine rib or wall without interference by the pivotal connecting of the movable portion 136 to the carrier portion 138 with the mine wall. Positioning the pivot housings 148 and 150 within the interior of the movable portion 136 increases the maneuverability of the bucket 62 within the close confines of an underground mine. The bucket 62 can be positioned substantially in abutting relation with the mine rib, for example, to clean-up loose material deposited on the mine floor adjacent the rib. This would not be possible if the pivot connection were positioned outboard of the sidewalls 152 and 154 of the bucket carrier portion 138. In addition positioning the pivot housings 148 and 150 within the bucket 162 protects the pivotal connections of the movable and carrier portions 136 and 138 against damage by contact with a rib or pillar when the bucket 62 is moved into position adjacent thereto.

Each of the pivot housings 148 and 150 includes a bifurcated end portion generally designated by the numeral 180. The bifurcated end portions 180 extend through the respective openings 176 and 178 in the back wall 160 of the carrier portion 138. The outer end of each bifurcated end portion 180 is pivotally connected by a pin 182 to an extensible piston rod 184 of a piston cylinder 186 forming the respective piston cylinder assemblies 140 and 142.

As seen in FIG. 6, each of the piston cylinders 186 is pivotally connected to the bucket carrier portion 138 by a pivot pin 188 that extends through aligned bores in the respective side wall 152 and 154, an ear 190 extending from the end of each piston cylinder 186, and a support plate 192 secured to and extending rearwardly from the carrier portion back wall 160. Preferably the support plates 192 are welded to the back wall 160 and are reinforced by ribs 193.

The actuation of the piston cylinder assemblies 140 and 142 is controlled by the supply of fluid under pressure directed through hydraulic conduits that communicate with opposite ends of the piston cylinders 186. As seen in FIG. 6, a conduit 194 is connected to the rear of each piston cylinder 186 to supply fluid under pressure to the piston cylinder 186 to extend the piston rod 184 and pivot the movable portions 136 into a fully retracted position within the carrier portion 138. Conversely by supplying fluid under pressure to the upper end of each piston cylinder 186 through a separate conduit (not shown), the piston rod 184 is retracted to thereby pivot the bucket movable portion 136 about the pivot pins 144 and 146 away from the carrier portion 138, such as illustrated in FIG. 7 to a preselected position where the movable portion 136 is spaced from the carrier portion 138.

By controlling the relative position of the bucket movable portion 136, the multi-purpose bucket 62 can be used in clamshell operations where the movable portion 136 is spaced from the carrier portion 138 so as to permit grappling of loose material, large rocks, supports, roof timbers or any other material obstructing the passageway. Conversely by actuating the piston cylinder assemblies 140 and 142 to extend the piston rods 184, the movable portion 136 is advanced into the carrier portion 138 where the bucket 62 is suitable for use in bulldozing operations, as well as, cutting, grading or loading operations.

Thus it will be apparent that the bucket 62 may be operated in a variety of methods to conduct numerous material handling operations that are frequently encountered in underground mining operations. Heretobefore these operations required the use of more than one machine. The present invention, however, permits the use of a single self-propelled vehicle to conduct these operations. Thus the present invention replaces a number of machines to carry out a wide variety of material handling operations encountered in underground mining. This provides the advantages of economy and efficiency in the performance of materials handling in underground mining.

As seen in FIGS. 5 and 6, the line of action or the longitudinal axis of the piston rods 184 extends through the transverse center of the pivot pins 182 and 188 and above the pivot pins 144 and 146 that pivotally connect the movable portion 136 to the carrier portion 138. This arrangement provides improved pivotal movement of the movable portion 136 upon actuation of the piston cylinder assemblies 140 and 142. Also by connecting the piston rods 184 to the bifurcated end portions 180 of the respective pivot housings 148 and 150, a lever arm action is created between the connection of the movable portion 136 to the piston cylinder assemblies 140 and 142 and to the carrier portion 138.

The piston cylinder assemblies 140 and 142 are connected to the portions of the movable portion 136 that is pivotally connected to the carrier portion 138, i.e. the pivot housings 148 and 150. Thus, as clearly illustrated in FIG. 7, the bifurcated end portion 180 of each pivot housing 148 and 150 forms a lever arm that extends between the respective pairs of pivot pins 182, 144 and 182, 146. This arrangement facilitates ease of movement of the movable portion 136 between a fully retracted position within the carrier portion 138 and a fully extended position where the movable portion 136 is pivoted away from the carrier portion 138 as shown in phantom in FIG. 2, as well as, movement to an intermediate position as illustrated in FIG. 7.

As stated above, the boom assembly 52 is releasably engagable with the multi-purpose bucket 62 by connecting of the bracket 130 of the boom 62 to the bracket receiver 132 of the bucket 62. As illustrated in FIGS. 4, 6 and 7, the bracket receiver 132 is formed by a pair of parallel spaced bracket receiver plates 196 and 198 that are welded at their forward edge portion to the rear of the carrier portion back wall 160. The bracket receiver plates 196 and 198 are centrally positioned on the back wall 160 and are spaced a preselected distance apart to receive in abutting slidable relation a pair of plates 200 and 202. The plates 200 and 202 are the forwardly extending portions of the pair of ears 122 that extend through the plates 126 and 128 on the end of the boom assembly 52. The plates 200 and 202 form the bracket 130 on the end of the boom assembly 52.

The connection of the bracket plates 196 and 198 to the back wall 160 is rigidified by welded connection of the bracket receiver plates 196 and 198 to a pair of upper reinforcing members 204 and 206 and a pair of lower reinforcing members 208 and 210. The pair of upper reinforcing members 204 and 206 are welded to the bracket receiver plates 196 and 198 at the upper edges thereof and also to the rear of the reinforcing member 162 that extends across the top of the back wall 160. In a similar arrangement, the pair of lower reinforcing members 208 and 210 are welded to the bottom edge of the bracket receiver plates 196 and 198 and to an L-shaped rib member 212 that, as seen in FIG. 7, is welded to the back wall 160 and the bottom wall 156 of the carrier portion 138.

To further reinforce the connection of the bracket receiver plates 196 and 198 to the bucket carrier portion 138 as illustrated in FIG. 6, an upper connecting plate 214 is welded to the upper edges of the bracket receiver plates 196 and 198 and to the reinforcing member 162. Similarly at the bottom of the bracket receiver plates 196 and 198, a lower connecting plate 216 is welded to the lower edges of the plates 196 and 198, as well as, to the L-shaped rib member 212. With this arrangement the bracket receiver plates 196 and 198 are rigidly connected to the carrier portion back wall 160.

In addition to maintain the bracket receiver plates 196 and 198 spaced a preselected distance apart a pair of upper and lower spacer plates 218 and 220, illustrated in FIGS. 6 and 7, extend horizontally between the plates 196 and 198 and are welded at the end portions thereof to the plates 196 and 198. The horizontal spacer plates 218 and 220 are positioned a preselected distance apart to receive the bracket 130 on the end of the boom assembly 52 in a manner to assure rapid connection of the pins 134 to the plates 200 and 202 on the boom assembly 52 and the plates 196 and 198 on the bucket carrier portion 138.

As illustrated in FIGS. 4 and 7, the bracket receiver plates 196 and 198 each include a pair of apertures 222 and 224 that are coaxially aligned with corresponding apertures in each plate 196 and 198. Also as seen in FIG. 7, the apertures 222 and 224 are centrally positioned between the upper and lower horizontally positioned spacer plates 218 and 220. Correspondingly, the plates 200 and 202, forming the bracket 130 on the end of the boom assembly 52, include pairs of spaced apart apertures 226 and 228. The apertures 226 in plates 200 and 202 are coaxially aligned, and similarly the apertures 228 in pltes 200 and 202 are coaxially aligned.

With this arrangement to attach the boom assembly 52 to the bucket 62, the boom first end portion 56 is positioned to the rear of the bucket carrier portion 138. The bracket 130 is positioned oppositely of the bracket plates 196 and 198 and between the spacer plates 218 and 220. Then upon extension of the boom first end portion 56, the bracket 130 is inserted between the vertically spaced bracket receiver plates 196 and 198 and in contact therewith between the horizontally positioned upper and lower spacer plates 218 and 220.

As illustrated in FIG. 7, the vertical dimension of the plates 200 and 202 forming the bracket 130 corresponds substantially to the vertical dimension separating the upper and lower spacer plates 218 and 220 between the bracket plates 196 and 198. This assures that when the boom first end portion 56 has been fully extended to the point where the plate 128 on the end of the boom is abutting the bracket receiver plates 196 and 198, as illustrated in FIGS. 3 and 7, further forward movement of the plates 200 and 202 between the bracket receiver plates 196 and 198 is restrained. In this position the bracket 130 is in alignment with the bracket receiver 132 so that the apertures 226 and 228 of plates 200 and 202 are aligned with the apertures 222 and 224 of plates 196 and 198. The pins 134 are than advanced through the aligned apertures to complete the connection of the boom assembly 52 to the multi-purpose bucket 62.

Thus it can be seen that the attachment and detachment of the boom assembly 52 to the multi-purpose bucket 62 is easily and quickly accomplished without the need of complicated linkages. Furthermore, this type of connection is particularly advantageous for attaching and detaching the bucket 62 to the boom 52 in an underground mine where the space limitations substantially restrict the ability of workmen to maneuver machine components. The connection of the present invention thus eliminates many of the problems heretobefore encountered in the assembly and disassembly of material handling equipment in an underground mine. Further by providing an efficient manner of detaching the bucket 62 from the boom assembly 52 other material handling devices, such as disclosed in U.S. Pat. No. 4,199,299, can be connected to the end of the boom assembly 52 to permit the vehicle 10 to be used for other operations in an underground mine thereby expanding the versatility of the self-propelled vehicle 10.

With the multi-purpose bucket 62 secured to the end of the boom assembly 52, the bucket 62 is movable both laterally and vertically by movement of the boom assembly 52. Lateral swinging movement of the boom assembly 52 is accomplished by actuation of the piston cylinder assemblies 64 and 66 as above described. The piston cylinder assembly 80 illustrated in FIG. 2 is operable to vertically raise and lower the boom assembly 52 and is also laterally movable with the boom assembly 52. The cylinder portion 82 of the assembly 80 is connected by a vertical pin 230 that is secured at its lower end portion to the front end 16 to the mobile body frame 14. A collar 232 is positioned in surrounding relation with the pin 230 and is connected by ears 234 and a pivot pin 236 to the cylinder end portion 86.

The pivot pin 230 is vertically mounted on the front end 16 of the mobile body frame 14 by a pair of brace members 238 and 240 that are connected to the collar 232 in a manner described in greater detail in U.S. Pat. No. 4,199,299. Further a swivel housing 242 which is also described in greater detail in the aboved referenced patent facilitates lateral swinging movement of the boom assembly 52 on the frame 14. In view of the fact that this structure is beyond the scope of the present invention it will not be described further in greater detail.

By actuation of the piston cylinder assemblies 64 and 66 the boom assembly 52 is pivotal in either a clockwise or counterclockwise direction to selectively locate the bucket 62, as for example, to carry out cutting operations left or right of the vehicle 10 when the movable portion forward edge 170 is positioned on the main floor, as illustrated in FIG. 2. Once the bucket 62 is selectively positioned either left or right of the longitudinal axis of the vehicle 10 and the bucket 62 is in contact with the mine floor cutting or grading operations are performed by either extension of the boom assembly 52 by operation of the piston cylinder assembly 106 or by forwardly tramming the vehicle 10.

It is also possible to conduct bulldozing operations by adjusting the position of the bucket 62 to locate either the cutting edge plate 158 of the carrier portion 138 or the movable portion forward edge 170 in position on the mine floor to ride on the surface of the mine floor as opposed to cutting into the mine floor. Swinging the bucket 62 laterally is accomplished by the simultaneous extension and retraction of the respective piston cylinder assemblies 64 and 66.

In a further example of the operation of the multi-purpose bucket 62 once a cutting operation has been performed by the carrier portion 138 with the movable portion 136 raised as shown in FIG. 2, the movable portion 136 is lowered into the carrier portion 138 and the bucket 62 vertically raised to the position illustrated in phantom in FIG. 2. It should be pointed out that the bulldozing or cutting operations of the bucket 62 can be performed by either the carrier portion 138 with the movable portion 136 raised or the movable portion 136 retracted into the carrier portion 138.

Once the carrier portion 138 has been filled with the loose material, hauling operations are accomplished by vertically raising the boom assembly 52 by retraction of the piston rod 84 into the piston cylinder assembly 82. The boom then by operation of the piston cylinder assembly 64 and 66 may be swung either left or right to locate the bucket 62 in position to discharge the material, for example on a haulage belt or into a haulage vehicle.

As a further example of the versatility of the bucket 62 to carry out material handling operations in a mine, the movable portion 136 can be spaced from the carrier portion 138, as illustrated in FIG. 7, and with the boom assembly 52 raised, as illustrated in phantom in FIG. 2, to position the bucket 62 for clamshell operations. The bucket 62 is then moved downwardly into engagement with a large obstacle to be grasped between the bucket carrier portion 138 and the bucket movable portion 136. Also clamshell operations can be conducted by advancing the carrier portion 138 on the mine floor into contact with an obstacle with the movable portion 136 in a raised position. Thereafter the movable portion 136 is pivoted downwardly by operation of the piston cylinder assemblies 140 and 142 so that the rearward edge of the movable portion 136 is brought into contact with the material in the carrier portion 138. By engaging the material, such as dislodged mine material, rock, timbers, debris and the like, the material is moved and transportated to another location.

Thus the multi-purpose bucket 62 of the present invention is capable of performing a wide variety of material handling operations in an underground mine. These operations may be efficiently carried out by the selective maneuvering of the bucket 62 by movement of the boom assembly 52 and by movement of the bucket movable portion 136 relative to the bucket carrier portion 138. Also by the efficient manner in which the bucket 62 is attachable and detachable to the end of the boom assembly 52, the self-propelled vehicle 10 with the extensible boom assembly 52 may be easily converted to another use in carrying out numerous operations in an underground mine.

In addition the pivotal connection of the bucket movable portion 136 to the bucket carrier portion 138 and the manner in which the portion 136 is moved relative to the portion 138 permits efficient conversion of the bucket 62 from an excavating-loading type device to a clamshell-bulldozing type device. This feature of the present invention eliminates the need for two or more different types of machines to conduct in a mine a number of material handling operations which now can be accomplished by the use of a single machine.

According to the provisions of the patent statutes, we have explained the principle, preferred instruction, and mode of operation of our invention and have illustrated and describe what we now consider to represent its best embodiments. However, it should be understood that, within the scope of the appended claims, the invention may be practiced otherwise than as specifically illustrated and described.

We claim:

1. A multi-purpose underground material handling machine comprising, a mobile body, a boom assembly extending from said mobile body, said boom assembly having a first end portion positioned on said mobile body and a second end portion spaced from said first end portion and said mobile body, said second end portion being extensible and retractable relative to said first end portion to change the length of said boom assembly, said boom assembly first end portion being pivotally connected to said mobile body for both lateral and vertical pivotal movement of said boom assembly relative to said mobile body, first actuating means mounted on said mobile body and connected to said boom assembly for pivoting said boom assembly both laterally and vertically relative to said mobile body, a multi-purpose bucket including a movable portion and a carrier portion, pivot means for connecting said movable portion to said carrier portion to permit pivotal movement of said movable portion toward and away from said carrier portion, second actuating means extending between said bucket movable and carrier portions for moving said movable portion to a preselected operating position relative to said carrier portion, said carrier portion including a pair of laterally spaced side walls secured to both a back wall and a bottom wall to form an enclosure with an open end portion to receive loose material, said movable portion including a pair of laterally spaced side walls secured to a bottom wall whereby loose material is freely movable through said movable portion, said movable portion being positioned within said carrier portion such that said movable portion side walls are positioned inboard and closely adjacent to said carrier portion side walls for movement of said movable portion side walls relative thereto, said movable portion bottom wall being movable in overlying relation with said carrier portion bottom wall, a bracket extending forwardly from said boom assembly second end portion, a bracket receiver extending rearwardly from said bucket carrier portion into contact with said bracket with said boom assembly positioned centrally behind said multi-purpose bucket, quick release pin means for connecting said bracket receiver to said bracket to permit efficient attaching and detaching of said multi-purpose bucket to said boom assembly, and extensible means for extending and retracting said boom assembly to selectively manuever said multi-purpose bucket into position for conducting material handling operations.

2. A multi-purpose underground, material handling machine as set forth in claim 1 in which, said mobile body has a longitudinal axis, said multi-purpose bucket having a forwardly positioned ground engaging plate, a pivot pin secured to said mobile body and extending upwardly therefrom, said boom assembly being supported by said pivot pin for lateral swinging movement forwardly of said mobile body, and said boom assembly being movable through an arcuate path to position said ground engaging plate at a preselected angle relative to said longitudinal axis in contact with a mine floor.

3. A multi-purpose underground, material handling machine as set forth in claim 1 in which, said boom assembly is connected to said mobile body for pivotal movement about a horizontal axis to effect upward and downward movement of said boom assembly to position said multi-purpose bucket at a preselected elevation relative to said mobile body, and piston cylinder means connected to and extending between said mobile body and said boom assembly for positioning said multi-purpose bucket at a preselected vertical height.

4. A multi-purpose underground, material handling machine as set forth in claim 1 in which, said multi-purpose bucket includes a forwardly positioned ground engaging plate, said boom assembly being connected to said mobile body to raise and lower said multi-purpose bucket to move said ground engaging plate into and out of contact with a mine floor, and said ground engaging plate being operable to move forwardly on the mine floor upon extension of said boom assembly to convey material on the mine floor in advance of said ground engaging plate into said multi-purpose bucket.

5. A multi-purpose underground material handling machine as set forth in claim 1 which, said movable portion is pivotally supported by said carrier portion to move into and out of said carrier portion, said pivot means including a pivot housing supported within said movable portion to protect said pivot means from damage by external forces applied to said multi-purpose bucket, and pin means retained in said pivot housing and extending through said movable and carrier portions for connecting said movable portion to said carrier portion to permit pivotal movement of said movable portion.

6. A multi-purpose underground material handling machine as set forth in claim 1 in which, said pivot means are supported by said movable portion side walls for connecting said movable portion side walls to said carrier portion side walls for pivotal movement of said movable portion relative to said carrier portion.

7. A multi-purpose underground, material handling machines as set forth in claim 6 which includes, a pair of openings extending through said carrier portion back wall, said pivot means being connected to said movable portion side walls and said carrier portion side walls, said pivot means including a pair of lever arms extending through said pair of openings respectively, and said second actuating means being connected to said lever arms so that actuation of said second actuating means moves said lever arms to pivot said movable portion relative to said carrier portion about said pivot means.

8. A multi-purpose underground, material handing machine as set forth in claim 1 in which, said bracket receiver includes a pair of plates secured to and extending rearwardly in spaced parallel relation from said carrier portion, said plates each having axially aligned apertures therethrough, spacer plates positioned in spaced relation a preselected distance apart above and below said apertures and between said bracket receiver plates, and said bracket being provided with apertures and arranged to extend into overlapping contact with said bracket receiver plates where said spacer plates guide said bracket into position to align said bracket apertures with said bracket receiver plate apertures to receive said quick release pin means.

9. A multi-purpose underground, material handling machine as set forth in claim 8 which includes, a pair of parallel spaced plates forming said bracket, said bracket plates being movable into and out of slidable abutting relation with said bracket receiver plates, and said bracket plates being spaced a distance apart and having a vertical dimension so as to be received within and abutting said bracket receiver plates and said spacer plates to assure alignment of said apertures for insertion and removal of said quick release pin means to permit efficient attachment and detachment of said bracket to said bracket receiver.

10. A multi-purpose underground material handling machine as set forth in claim 1 in which, said pivot means includes a pivot pin pivotally connecting said movable portion to said carrier portion and a lever extending from said movable portion rearwardly through said carrier portion, said lever extending from the rear of said carrier portion, said second actuating means including a piston cylinder assembly having a cylinder portion connected to said carrier portion and an extensible piston rod, a pivot pin pivotally connecting said piston rod to said lever, and said piston rod being movable into and out of said cylinder portion to move said lever about said pivotal connection of said movable portion to said carrier portion for pivotal movement of said movable portion away from and toward said carrier portion.

11. A multi-purpose underground material handling machine comprising, a mobile body, a boom assembly extending from said mobile body, said boom assembly having a first end portion positioned on said mobile body and a second end portion spaced from said first end portion and said mobile body, said second end portion being extensible and retractable relative to said first end portion to change the length of said boom assembly, said boom assembly first end portion being pivotally connected to said mobile body for both lateral and vertical pivotal movement of said boom assembly relative to said mobile body, first actuating means mounted on said mobile body and connected to said boom assembly for pivoting said boom assembly both laterally and vertically relative to said mobile body, a multi-purpose bucket including a movable portion and a carrier portion, said movable portion positioned within said carrier portion, pivot means for connecting said movable portion to said carrier portion to permit pivotal movement of said movable portion within said carrier portion toward and away from said carrier portion, second actuating means extending between said bucket movable and carrier portions for moving said movable portion to a preselected operating position relative to said carrier portion, said movable portion being movable upon actuation of said second actuating means between an open position out of said carrier portion and a closed position in said carrier portion, said movable portion being selectively movable to a position between said open and closed positions, said carrier portion including a pair of spaced apart side walls secured to a back wall and a bottom wall to form an enclosure having an open end portion to receive loose material, said movable portion including a pair of spaced apart side walls secured to a bottom wall, said carrier portion back wall forming a back wall for said movable portion when said movable portion is in said closed position within said carrier portion, said movable portion side walls being spaced from said carrier portion side walls and said movable portion bottom wall overlying said carrier portion bottom wall to permit pivotal movement of said movable portion within said carrier portion, a bracket extending forwardly from said boom assembly second end portion, a bracket receiver extending rearwardly from said bucket carrier portion into contact with said bracket with said boom assembly positioned centrally behind said multi-purpose bucket, quick release pin means for connecting said bracket receiver to said bracket to permit efficient attaching and detaching of said multi-purpose bucket to said boom assembly, and extensible means for extending and retracting said boom assembly to selectively maneuver said multi-purpose bucket into position for conducting material handling operations.

12. A quick release connection of a materials handling bucket to a boom comprising, a bucket having a back wall, a bracket receiver formed by a pair of parallel spaced plates positioned centrally behind said back wall and extending rearwardly from said back wall, said pair of parallel spaced plates having oppositely aligned apertures therethrough, a pair of spacer plates extending between and secured to said pair of parallel spaced plates for separating said pair of parallel spaced plates a preselected distance apart, said pair of spacer plates being positioned in spaced parallel relation a preselected distance apart, a boom having a bracket extending forwardly therefrom and being positioned centrally behind said bucket back wall, said bracket including an abutment plate and a pair of parallel spaced bracket plates secured to and extending forwardly of said abutment plate and said pair of parallel spaced bracket plates including oppositely aligned apertures therethrough, said pair of bracket plates being positioned for slidable movement between and into abutting relation with said bracket receiver pair of parallel spaced plates, said pair of bracket plates being guided by said spacer plates as said bracket plates move between and in contact with said bracket receiver pair of parallel spaced plates into a position where said abutment plate abuts the ends of said bracket receiver pair of parallel spaced plates and said apertures of said bracket are aligned with said apertures of said bracket receiver, and pins extending through said aligned apertures to permit efficient attachment and detachment of said bucket to said boom.

13. A multi-purpose materials handling bucket comprising, a movable portion including a pair of spaced apart side walls secured to a bottom wall, a carrier portion including a pair of spaced apart side walls secured to both a back wall and a bottom wall to form an enclosure with an open end portion toe receive loose material, said carrier portion being maintained in a fixed position relative to said movable portion, said movable portion being positioned within said carrier portion with said movable portion side walls being positioned inboard and closely adjacent to said carrier portion side walls for pivotal movement of said movable portion within said carrier portion, said movable portion bottom wall overlying said carrier portion fixed bottom wall, pivot means being supported by said movable portion side walls for pivotally connecting said movable portion to said carrier portion such that loose material is freely movable through said movable portion and received in said enclosure of said carrier portion, a pair of openings extending through said carrier portion back wall, said pivot means including a pair of lever arms extending through said pair of openings respectively, and means supported by said carrier portion and connected to said lever arms for exerting a force upon said lever arms to pivot said movable portion to a preselected position within said carrier portion.

* * * * *